US006304253B1

(12) United States Patent
Sung et al.

(10) Patent No.: US 6,304,253 B1
(45) Date of Patent: Oct. 16, 2001

(54) HORIZONTAL POSITION CONTROL CIRCUIT FOR HIGH-RESOLUTION LCD MONITORS

(75) Inventors: Jun-Ho Sung; Seong-Eun Chung, both of Seoul (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/289,609

(22) Filed: Apr. 12, 1999

(30) Foreign Application Priority Data

Apr. 11, 1998 (KR) ..... 98-12974

(51) Int. Cl.[7] ..... G09G 3/36

(52) U.S. Cl. ..... 345/187; 345/132; 345/212; 345/214

(58) Field of Search ..... 345/87, 150, 153, 345/154, 326, 327, 212, 214, 132; 348/558

(56) References Cited

U.S. PATENT DOCUMENTS

| | | | | |
|---|---|---|---|---|
| 5,539,473 | | 7/1996 | Kommrusch et al. . | |
| 5,767,916 | | 6/1998 | West . | |
| 5,790,096 | * | 8/1998 | Hill, Jr. | 345/150 |
| 5,805,233 | | 9/1998 | West . | |
| 6,052,118 | * | 4/2000 | Beeteson et al. | 345/207 |
| 6,078,361 | * | 6/2000 | Reddy | 348/558 |

* cited by examiner

*Primary Examiner*—Steven Saras
*Assistant Examiner*—Fritz Alphonse
(74) *Attorney, Agent, or Firm*—Robert E. Bushnell, Esq.

(57) ABSTRACT

A horizontal position control circuit for use in high-resolution LCD monitors is disclosed. The horizontal position control circuit comprises a key pad for adjusting horizontal position of an image displayed; a key input controller for invoking a horizontal position control signal in response to input key signal; an analog-to-digital converter for dividing analog video signals by 2N (N=integers) and for converting the divided analog video signals into the corresponding digital video data; a frame memory for storing the digital video data output from the analog-to-digital converter; and a controller in response to the horizontal position control signal to adjust sampling point of the analog-to-digital converter so that the horizontal position is adjusted by unit pixel, and to adjust output timing of write enable signals directed to the frame memory so that the horizontal position is adjusted by multiple pixels. In the fine adjustment mode, the horizontal position is adjusted by the unit pixel, and in the coarse adjustment it is adjusted by multiple pixels. The fine adjustment is performed by controlling sampling point of the ADC block, while the coarse adjustment is performed by controlling write cycles of the frame memory block. The invention provides for an effective control of horizontal position of an image displayed in high-resolution LCD monitors above standard SXGA and UXGA modes by using the coarse adjustment function of the horizontal position controller.

5 Claims, 7 Drawing Sheets

HORIZONTAL POSITION CONTROL CIRCUIT FOR HIGH-RESOLUTION LCD MONITORS

CLAIM OF PRIORITY

This application makes reference to, incorporates the same herein, and claims all benefits accruing under 35 U.S.C. §119 from an application entitled *Horizontal Position Control Circuit For High-Resolution LCD Monitors* earlier filed in the Korean Industrial Property Office on Apr. 11, 1998, and there duly assigned Ser. No. 98-12974 by that Office.

BACKGROUND OF THE INVENTION

1. Field of the Invention

The present invention relates to an interface between personal computers and liquid crystal display (LCD) monitors, and more particularly to a horizontal position control circuit for high-resolution LCD monitors.

2. Background Art

Flat panel displays such as liquid crystal display and plasma display are considered as a substitute for cathode ray tube (CRT) displays for their compactness and low power consumption. Today, laptop and notebook computers chiefly use liquid crystal displays. Occasionally, a desktop computer system is equipped with a LCD monitor, although it is costly. Today's LCD panels adopt active matrix design, commonly referred to as thin film transistor (TFT) technology. This style of LCD puts a transistor at every pixel. The advantage of the active matrix design is that a smaller current needs to traverse the horizontal and vertical grid, so the pixel can be switched on and off faster.

LCD monitors include an interface circuit that converts analog video signals input from the system host into digital video signals for driving every pixel of the LCD panel. This compels LCD monitors to operate in a single display mode among the VGA(Video Graphic Array), SVGA(Super VGA), XGA(Extended Graphic Array), and SXGA(Super XGA) modes. Thus, the resolution of LCD monitors depends on the number of pixels formed in the active matrix which constitutes the active display area. For example, standard SXGA mode LCD monitors exactly have 1280×1024 pixels in the active display area. Unlike CRT monitors that require a bandwidth wide enough to address each individual screen dot plus an extra margin to allow for retrace times, the LCD monitor requires more precise control of input video signals for enabling the horizontal positioning that places the first pixel data on the first pixel of each individual scan line of the LCD screen.

Further, the resolution of LCD monitors needs to be increased in the personal computer and workstation to obtain sharper displayed images. The higher the resolution, the higher the bandwidth (dot-clock). However, the increase of resolution is limited due to the change characteristics of TFT-LCD, properties of driver ICs (integrated circuits), and response characteristics of various electronic devices in the LCD interface board. It has been known in the art that on the printed circuit board the bandwidth is limited to 135–140 MHZ due to an inherent parasitic capacitance. For the XGA mode LCD monitors, the bandwidth is about 60–80 MHZ and this is sufficient for the LCD monitors to process the XGA level input video signals. As to the SXGA mode LCD monitors the bandwidth will be more than about 160 MHZ, to fit a 90 Hz refresh rate. At this time, the period of one dot clock will be about 6.2 nS.

Conventionally, horizontal positioning is performed such that the sampling position is adjusted by the amount of $\pi/2$ by combining an encode clock with data synchronizing signals of the LCD interface circuit, thereby enabling adjustment of one pixel per dot clock. With this method, a maximum of 4 pixels are adjustable. However, for a higher synchronizing frequency range, the adjustable range should be often or more pixels. Thus, it is difficult to adjust the horizontal position in the higher frequency range video signals with the conventional method.

Therefore, there is a need to provide an interface circuit which can facilitate controlling of the horizontal position in LCD monitors depending on input video signals with a high synchronizing frequency range of about a 90 Hz refresh rate.

Known apparatus and methods for producing a digital video signal from an analog video for display on an LCD is described in U.S. Pat. No. 5,539,473 to Steven J. Komnmruscb et al. entitled *Dot Clock Generation With Minimal Clock Skew*; and U.S. Pat. Nos. 5,805,233 and 5,767,916 both to Michael G. West and entitled *Method And Apparatus For Automatic Pixel Clock Phase And Frequency Correction In Analog To Digital Video Signal Conversion* describe automatic correction of the horizontal position of a video image on the LCD.

SUMMARY OF THE INVENTION

It is therefore an object of the invention to provide a horizontal position control circuit of a LCD interface circuit which can effectively control a horizontal position in high-resolution LCD monitors.

In accordance with the present invention, the horizontal position control circuit comprises a key pad for adjusting a horizontal position of an image displayed; a key input controller for invoking a horizontal position control signal in response to input key signal; an analog-to-digital converter for dividing analog video signals by 2N (where N is an integer) and for converting the divided analog video signals into corresponding digital video data; a frame memory for storing the digital video data output from the analog-to-digital converter; and a controller in response to the horizontal position control signal to adjust a sampling point of the analog-to-digital converter (ADC) so that the horizontal position is adjusted by unit pixel, and to adjust output timing of write enable signals directed to the frame memory so that the horizontal position is adjusted by multiple pixels.

The horizontal position controller performs a fine adjustment operation and coarse adjustment operation. In the fine adjustment mode, the horizontal position is adjusted by the unit pixel, and in the coarse adjustment it is adjusted by multiple pixels. The fine adjustment is performed by controlling the sampling point of an ADC block, while the coarse adjustment is performed by controlling write cycles of a frame memory block.

According to this invention, the interface circuit effectively controls horizontal position of an image displayed in high-resolution LCD monitors above standard SXGA mode. Further, the coarse adjustment function of the horizontal position controller is applicable for the UXGA (Ultra XGA) display mode LCD monitors operated with about 200 MHZ bandwidth input video signals.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
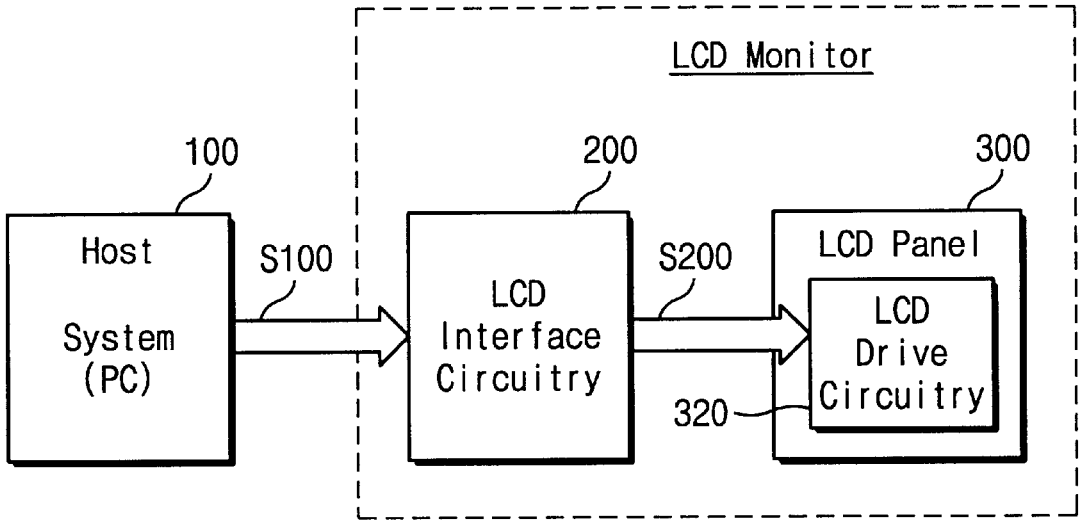
FIG. 1 is a block diagram of a LCD monitor for depicting a PC (personal computer) to LCD interface scheme.

Referring to FIG. 1, there is shown a LCD monitor for use with a host system 100 such as a personal computer (PC). The LCD monitor commonly has an interface circuit 200 and a LCD drive circuit 320. The interface circuit 200 couples the input video signals fed from the system host 100 to the LCD drive circuit 320. The LCD drive circuit 320 drives active matrix of the TFT-LCD panel 300 according to the input video signals.

The interface circuit 200 is provided with video signals S100 including R, G, B analog video signals and horizontal and vertical synchronizing signals, Hsync and Vsync. The interface circuit 200 converts the analog video signals S100 from the system host 100 into digital video signals S200. These digital video signals including controlled horizontal and vertical synchronizing signals, H'sync and V'sync, and a clock signal CLK (which may be a dot clock signal D_CLK) are supplied to the LCD drive circuit 320. The interface circuit 200 and LCD drive circuit 320 are incorporated into a printed circuit board (PCB) which is being installed in the LCD monitor.

Figure 2:
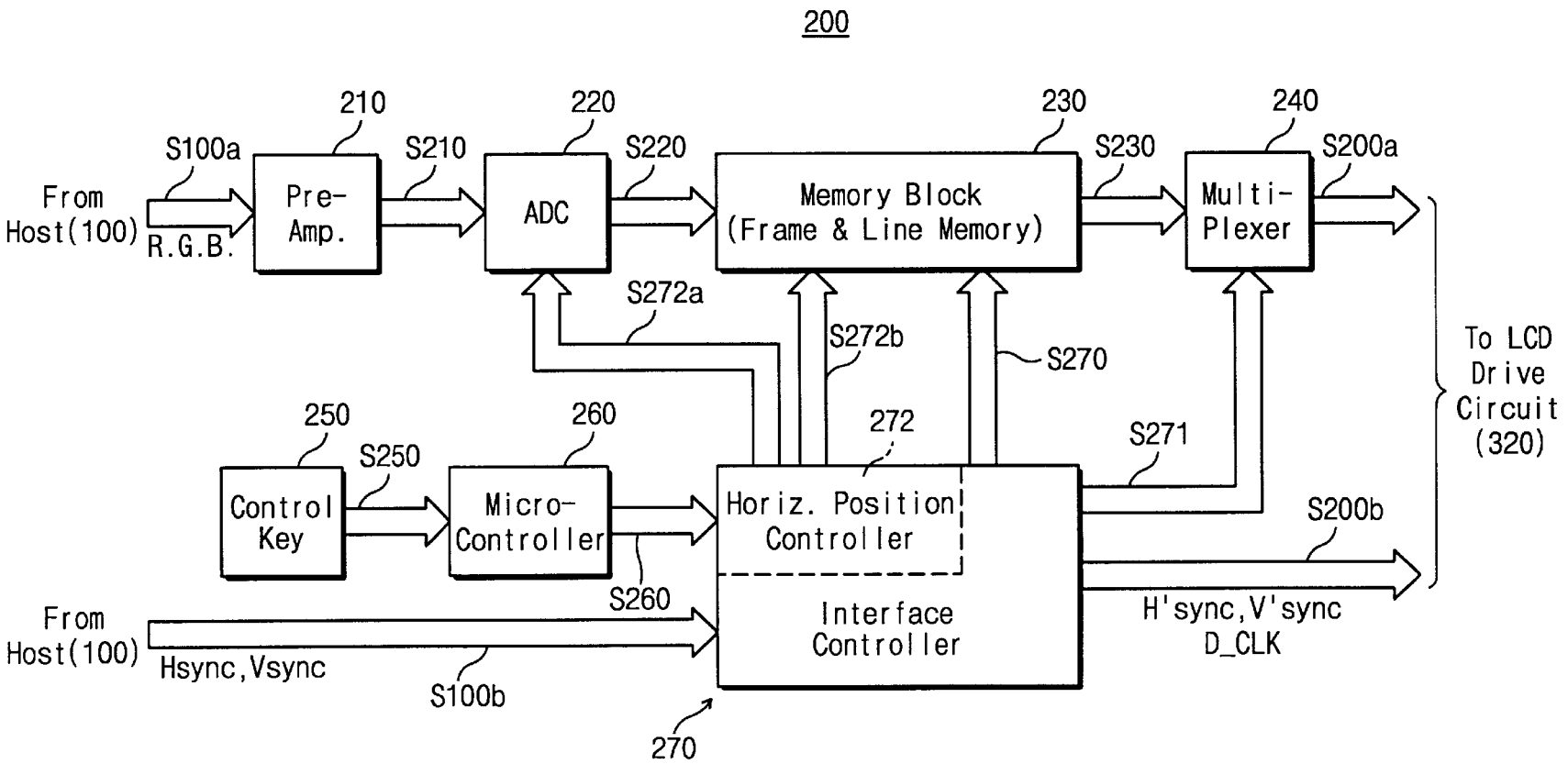
FIG. 2 is a block diagram of a LCD interface circuit in accordance with the present invention.
Figure 3:
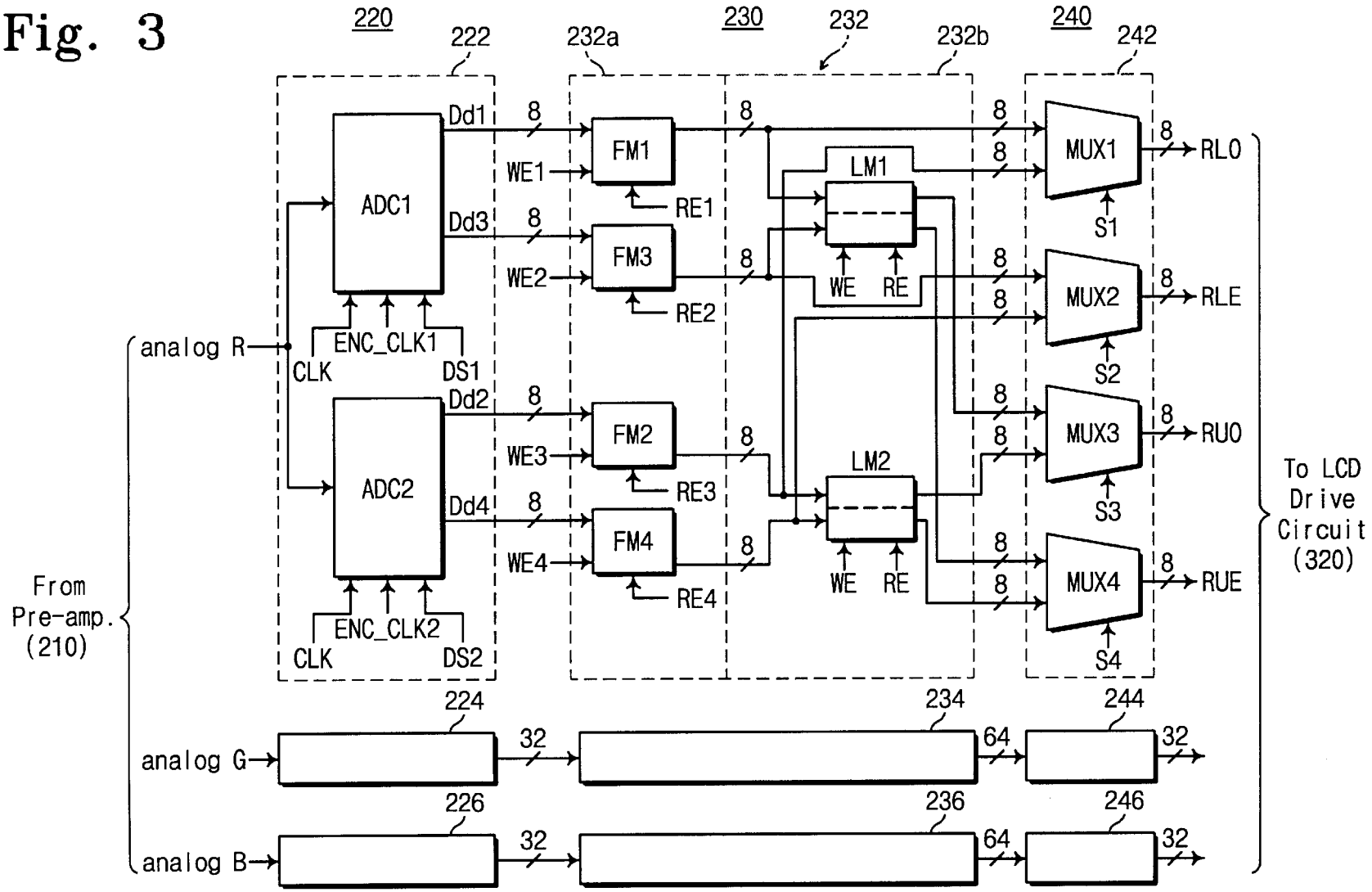
FIG. 3 is a detailed block diagram of the ADC block and memory block of the LCD interface circuit shown in FIG. 2.
Figure 4:
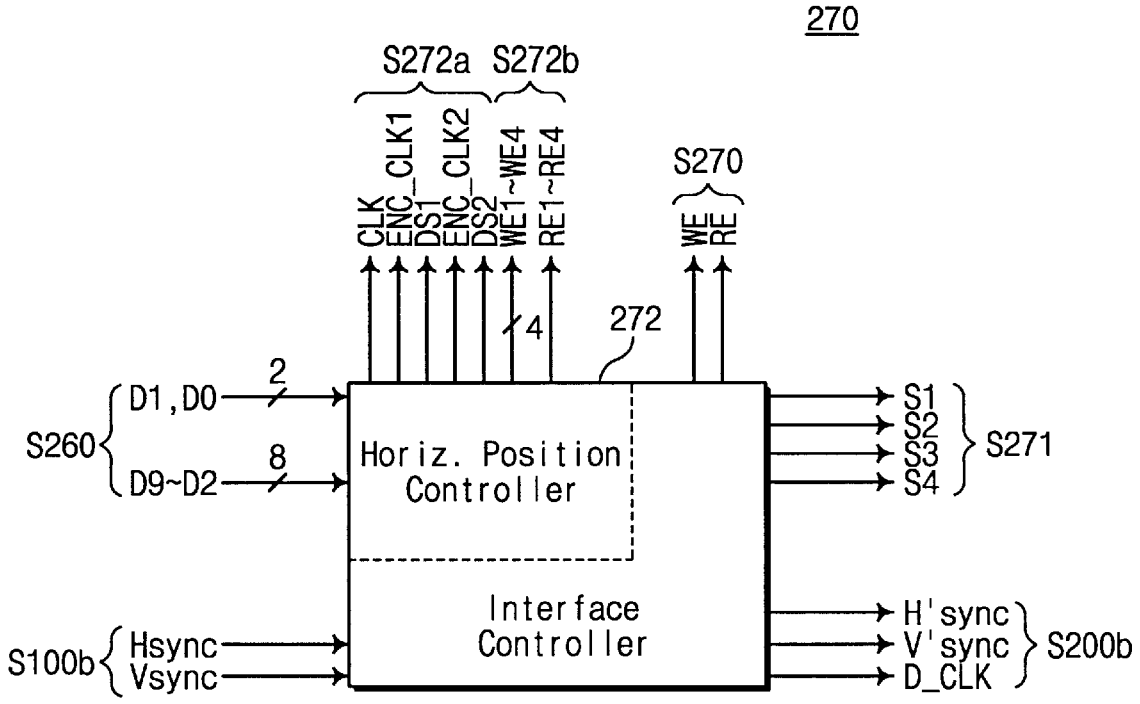
FIG. 4 is a diagram depicting input/output terminals of the interface controller of FIG. 2.

The configuration of the LCD interface circuit 200 is shown in FIG. 2 to 4 in accordance with the present invention. Between the R, G, B analog video signal input and digital video data output, connected in series are pre-amplifier block 210, analog-to-digital converter (ADC) block 220, a memory block 230, and multiplexer block 240. The interface circuit 200 further includes an interface control unit 270 which has inputs for the horizontal and vertical synchronizing signals Hsync, Vsync and for some control signals provided by a microcontroller 260. The microcontroller 260 is coupled with a control key pad 250 of the LCD monitor. The interface control unit 270 includes a horizontal position controller 272 and is coupled to the ADC block 220, the memory block 230, and the multiplexer 240 via horizontal control signal lines S272*a*, S272*b*, S270 and S271. The interface control unit 270 further includes a clock generator, for generating the clock signal CLK, and an OSD (On Screen Display) control circuit however, these circuits have been omitted to simplify the drawings.

The pre-amplifier 210 amplifies the R, G. B analog video signals S100*a* provided by the system host 100 and outputs the amplified R, G, B analog video signals S210 to the ADC block 220. The ADC block 220 converts the input R, G, B analog video signals S210 into the digital video a signals for supply to the memory block 230. The memory block 230 consists of a frame memory block and a line memory block, and is responsive to read/write control signals S272*b*, address signals (not shown) and read/write enable signals S270 to store the output digital video signals from the ADC block 220. The detailed configuration and operation of the ADC block 220 and memory it block 230 will be described with reference to FIG. 3. The digital video signals S230 stored in the memory block 230 are supplied to the multiplexer block 240. The multiplexer block 240, in response it to a selection control signals S271 fed from the interface control unit 270, selects desired digital video signals S200*a* among input video signals S230. The selected digital video signals S200*a* are supplied to the LCD drive circuit 320.

The interface control unit 270, including the horizontal position controller 272, controls the overall operation of the LCD interface circuit 200 and is preferably formed into an FPGA (Field Programmable Gate Array) or ASIC (Application Specific Integrated Circuits). Also, the control key pad 250 is installed outside of the monitor and includes a horizontal position control key operated by a user. The microcontroller 260 produces horizontal position control signals S260 in response to the corresponding control key input signals S250, and the horizontal position control signals S260 are supplied to the horizontal position controller 272.

The horizontal position controller 272 performs the horizontal position control operation in the fine adjustment mode and coarse adjustment mode. In the fine adjustment mode, the horizontal position is adjusted by the unit pixel, and in the coarse adjustment the horizontal position is adjusted by multiple pixels. The fine adjustment is performed by controlling the sampling point of the ADC block 220, while the coarse adjustment is performed by controlling the write cycle of the frame memory block. To this end, the horizontal position controller 272 outputs a control signal S272*a*, for controlling the sampling point, to the ACD block 220 in the fine adjustment mode, and adjusts the output timing of read/write control signals S272*b* directed to the memory block 230 in the coarse adjustment mode. Thus, the horizontal position adjustment operation is performed by the sampling point control of the analog video signals and by the write cycle control of the digital video signals being stored into the frame memory.

FIG. 3 shows a detailed block diagram of the ADC block 220, memory block 230, and multiplexer 240, related to the horizontal position adjustment operation. Each of the blocks 220, 230, and 240 are divided into three blocks of the same configuration. Thus, the ADC block 220 has three ADC blocks 222, 224, and 226, related to R, G, B analog video signals input, respectively. Also, the memory block 230 has three memory blocks 232, 234, and 236, and the multiplexer block 240 has three multiplexer blocks 242, 244, and 246. The following description is made for the blocks 222, 232, and 242 corresponding to R video signals, however, it is understood that the configuration and operation of the rest blocks related to G and B video signals are the same as the blocks related to R video signal.

In FIG. 3, the ADC block 222 consists of two analog-to-digital converters ADC1 and ADC2. Each converter has inputs for the R analog video signal, dot clock signal D_CLK, and sampling point control signals ENC_CLK1, ENC_CLK2, DS1 and DS2. Outputs of ADC1 are two 8-bit digital video data Dd1, Dd3 and outputs of ADC2 are two 8-bit digital video data Dd2, Dd4. Basically, the memory block 232 includes a frame memory block 232*a* and a line memory block 232*b*. The frame memory block 232*a* consists of a first pair of frame memories FM1, FM3 coupled to the digital video data outputs Dd1, Dd3, respectively, and a second pair of frame memories FM2, FM4 coupled to the digital video data outputs Dd2, Dd4, respectively. Also, the line memory block 232*b* consists of two line memories LM1, LM2, each having the capacity of storing two lines (i.e., two locations). Each frame memory has inputs for the digital video data fed from the ACD block 222, write cycle control signals WE1–WE4 and read cycle control signals RE1–RE4. Each line memory has inputs for the read/write enable signals RE, WE and inputs for the output data of the frame memories. The writing and reading of the line memories can be controlled simultaneously by the simultaneous application of the read/write enable signals RE, WE. In each line memory, a line of pixel data is written into one location thereof while a stored line of pixel data is read out from the other location thereof. The multiplexer block 240 consists of four multiplexers MUX1–MUX4, which selectively outputs the R digital video signals provided by the memory block 232. An image is displayed on the LCD in a dual scan mode in which the display screen is divided into two portions, i.e., an upper area and a lower area. The upper and lower areas are simultaneously scanned. For each scan line, pixel data signals on each scanning line fall into two groups, i.e., odd pixels and even pixels. Multiplexers MUX1 through MUX4 of multiplexer block 242, therefore, output red lower odd (RLO), red lower even (RLE), red upper odd (RUO) and red upper even (RUE) pixel data, respectively.

The input/output pin configuration of the interface controller 270 is shown in FIG. 4. The operation of the horizontal position controller will be described as follows:

When the user operates the control key 250, the horizontal position control signals S260 are produced by microcontroller 260 for input to horizontal position controller 272. The horizontal position control signals S260 consist of fine adjustment control signals D1 and D0, and coarse adjustment control signals D9–D2 as set in the following Table 1.

TABLE 1

| Function | Fine Adjustment (ADC) | Coarse Adjustment (Frame Memory) |
|---|---|---|
| Minimum Controllable Pixel/Dot Clock | 1 pixel | 4 pixels |
| Maximum Range | 4 pixels | 1024 pixels |
| Control Signals | ENC_CLK1, ENC_CLK2, DS1, DS2 | WE1-WE4 |
| Horiz. Position Control Data | D1, D0 | D9-D2 |

Analog video data signals are sampled by the ADCs in sync with the dot clock D_CLK (162 MHZ) and converted into digital data signals. Four dot clock cycles, corresponding to four pixels, are defined as a maximum fine control range of $2\pi$. Accordingly, $\pi/2$ denotes one dot clock cycle. In the fine adjustment operation, the sampling points of the analog-to-digital converters ADC1 and ADC2 are controlled. The horizontal position is adjusted by a pixel unit with the maximum range being 4 pixels. While, in the coarse adjustment the write cycles of the frame memories FM1–FM4 are controlled, and the horizontal position is adjusted by multiple pixels with a minimum of 4 pixels and maximum of 1024 pixels. Controlling of the sampling point of each of the analog-to-digital a converters ADC1 and ADC2 is determined by the value of the input control signals D1, D0 as set in the following Table 2.

TABLE 2

| Input | | Output | | | |
|---|---|---|---|---|---|
| D1 | D0 | DS1 | ENC_CLK1 | DS2 | ENC_CLK2 |
| 0 | 0 | H | H | L | L |
| 0 | 1 | H | L | H | H |
| 1 | 0 | L | H | H | L |
| 1 | 1 | L | L | L | H |

Figure 5A:
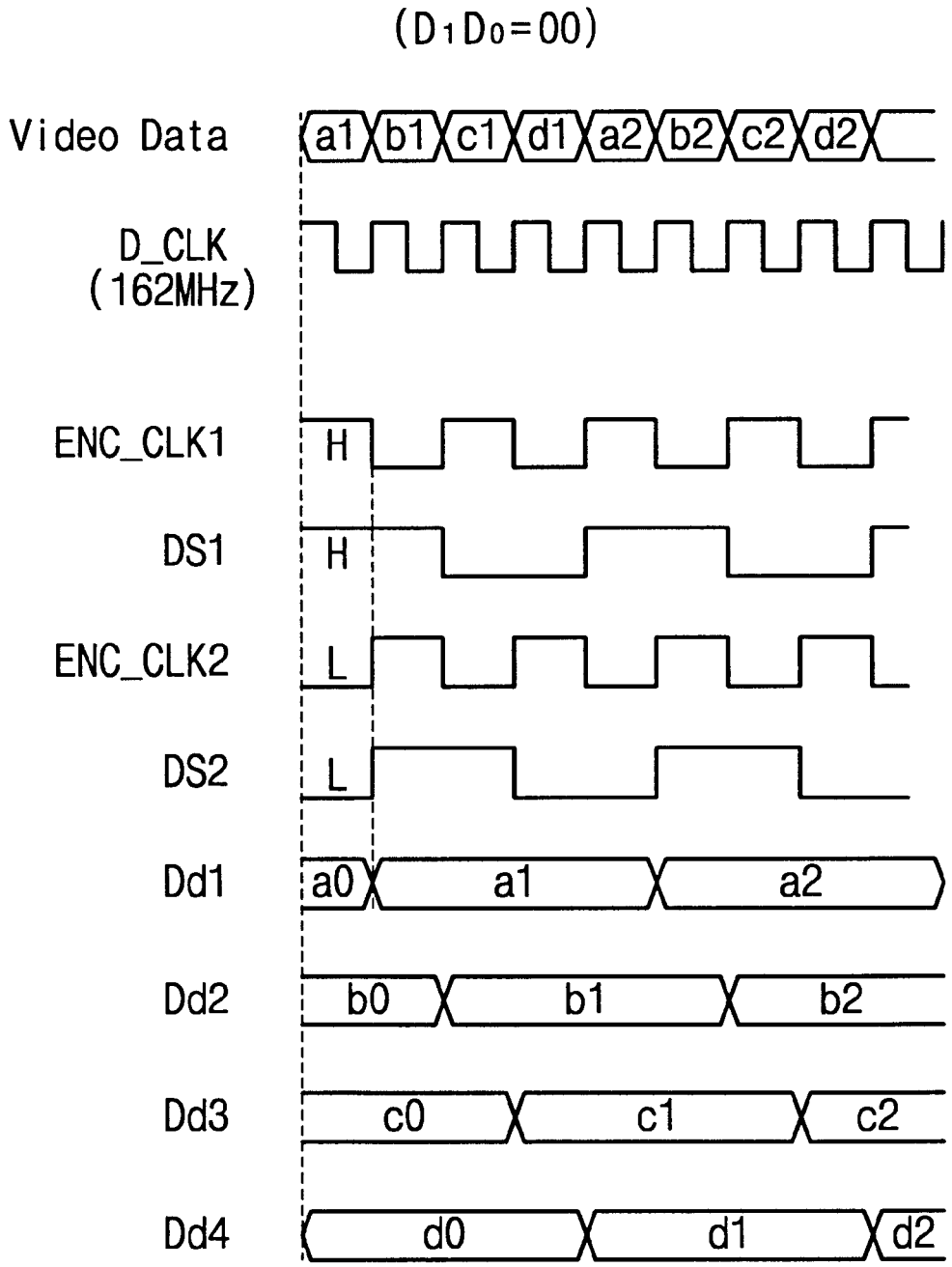
FIG. 5A and 5B are waveform diagrams of input/output signals of an analog-to-digital converter block for explaining the fine adjustment operation of the horizontal position control in which one pixel per dot clock adjustment is performed according to input control signals.
Figure 5B:
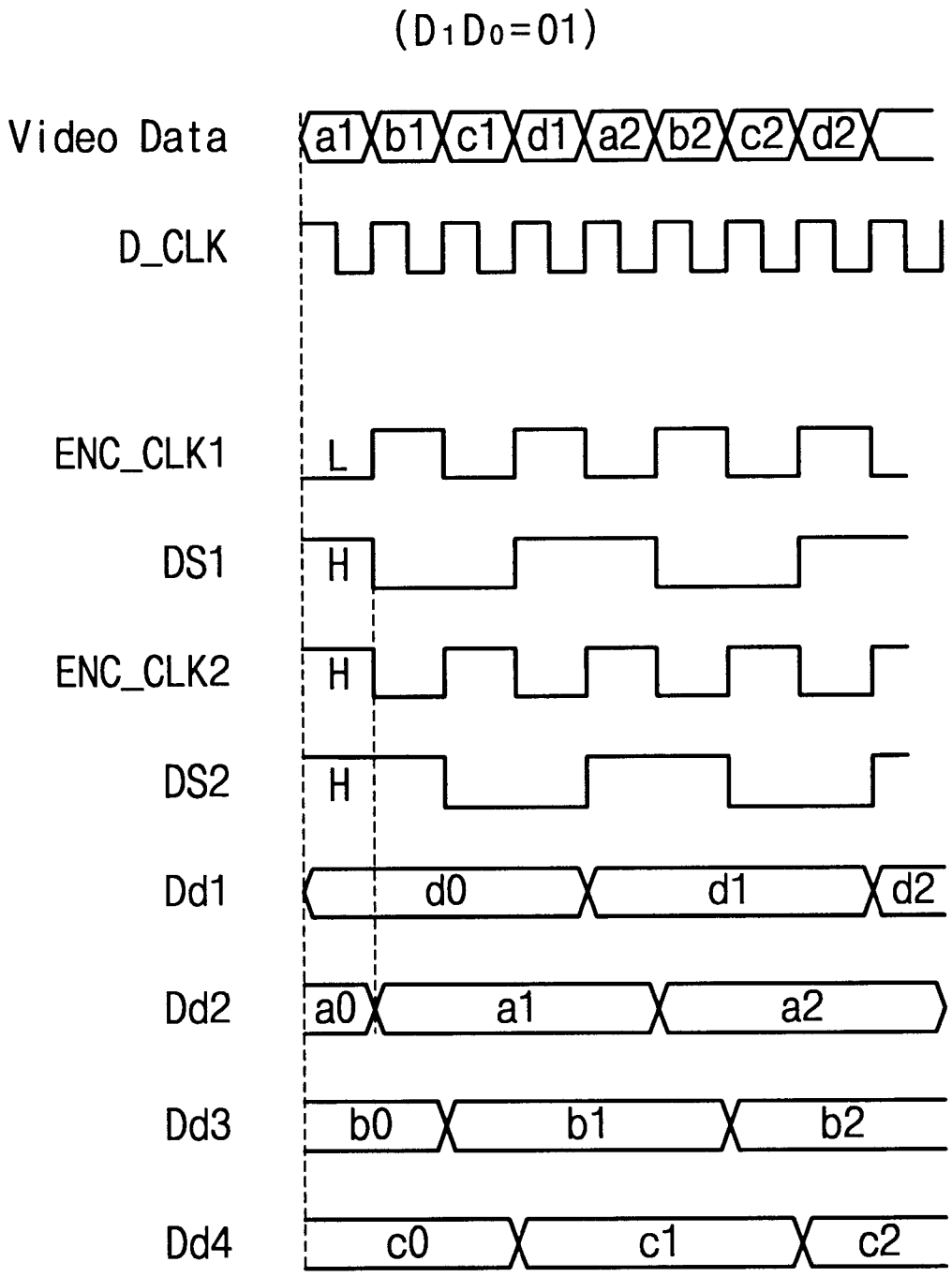

The sampling point control signals ENC_CLK1, ENC_CLK2 DS1 and DS2 directed to the ADC block 222 have potential variations depend on the logical value of the input control signals D1, D0. As shown in FIGS. 5A and 5B, ENC_CLK1 and ENC_CLK2 have a phase difference of 180° whereas DS1 and DS2 have a phase difference of $\pi/2$. In the fine adjustment mode, sampling points are adjusted at every $\pi/2$, thereby adjusting the horizontal position with one pixel per dot clock D_CLK. In this case, a maximum of 4 pixels at $2\pi$ are adjustable. When D1=0, D0=0, both fine adjustment control signals DS1 and ENC_CLK1 become high level signal H, whereas fine adjustment control signals DS2 and ENC_CLK2 become low level signal L, which results in the output of the digital video data (a1) at the output Dd1 of the ADC1 before the other video data Dd2, Dd3 and Dd4 are output, as shown in timing chart of FIG. 5A. On the other hand, when D1=0, D0=1, the fine adjustment control signal DS1 becomes high level H and ENC_CLK1 becomes low level signal, whereas both DS2 and ENC_CLK2 applied to ADC2 become high level signals H, which results in the output of the digital video data (a1) at the output Dd2 of the ADC2 before the other video data Dd1, Dd3 and Dd4 are output, as shown in timing chart of FIG. 5B. By changing the values of D1 and D2 from "00" to "01", the sampling point of each ADC was shifted left one pixel. The digital video data Dd1–Dd4 output from the ADC1 and ADC2 are stored in the corresponding frame memories FM1–FM4.

The coarse adjustment operation is performed by controlling write cycle of the frame memories FM1–FM4. To this end, the horizontal position controller 272 adjusts the output timing of write cycle control signals WE1–WE4 directed to the frame memories FM1–FM4. The output timing of write cycle control signals WE1–WE4 is determined by the horizontal position control data D9–D2. The horizontal position controller 272 reads out the horizontal position control data D9–D2 and outputs the write cycle control signals WE1–WE4 with a time difference so that the four pixel data signals sampled by ADC1 and ADC2 ore stored into frame memories FM1–FM4 one by one in order. The locations of FM1–FM4 correspond to the pixel positions on the screen. Controlling the timing of WE1–WE4 is able to bring about the changes in addresses of FM1–FM4, allowing the coarse control to be performed by the four pixel data. During the coarse control the operations of line memories LM1, LM2 and multiplexers MUX1–MUX4 are not affected. The pixel data signals corresponding to the upper area of the LCD screen in frame memories FM1–FM4 are transferred to lime memories LM1 and LM2. The pixel data signals corresponding to the lower area of the LCD screen in frame memories FM1–FM4 and the data signals previously stored in line memories LM1 and LM2 are simultaneously provided to the multiplexers MUX1–MUX4. Each multiplexer selects odd pixel data signals and even pixel data signals alternatively and provides them to the LCD drive circuit 320.

Figure 6:
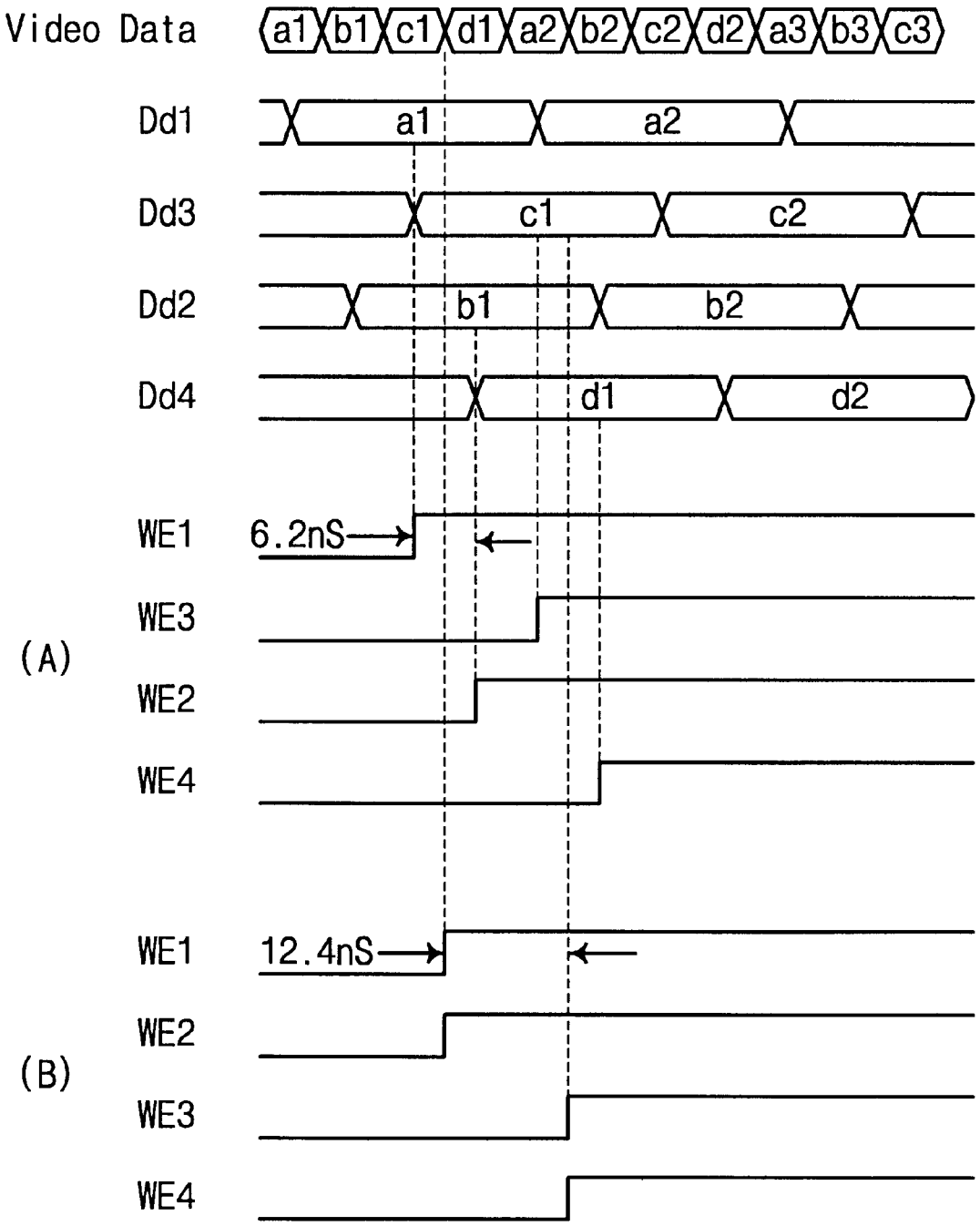
FIG. 6 is a waveform diagram of a part of input/output signals of the interface control circuit for explaining the coarse horizontal position adjustment operation in accordance with the invention.

For example, if the analog video signals has 162 MHZ bandwidth, about 40 MHZ (divided by 4) is used in this embodiment in consideration of the response characteristics of the LCD interface circuit 200 and drive circuit 320 as well as gate pulse duration of the LCD panel 300. As shown in FIG. 6, the write cycle control signals WE1–WE4, denoted by waveform group (A), have time difference of 6.2 nS from one another. Further, in the case of a multisync function monitor, the time difference of write cycle control signals WE1–WE4 may vary with the frequency of input analog video signals. Such time difference may affect the write cycle control signals WE1–WE4, resulting in distortion thereof due to the parasitic capacitance of the PCB (printed circuit board). In this case, preferably the timing difference of write cycle control signals WE1–WE4 can be doubled to have time difference of 12.4 nS, as denoted by waveform group (B). Further, the write cycle control signals WE1–WE4 are simplified such that they merely have two kind of waveforms by sampling the output timing of the write cycle control signals WE1–WE4 as much as ⅛ out of the center of the effective interval of the digital video data Dd1–Dd4. With this, stable horizontal control operation is possible in the horizontal position controller 272. It should be noted that to perform this control operation the frame memories FM1–FM4 may comprise a memory device in which data input/output operation is performed in asynchronous manner.

As described above, the interface circuit of this invention effectively controls horizontal position of an image displayed in high-resolution LCD monitors above standard SXGA mode. Further, the coarse adjustment function of the horizontal position controller can be used in UXGA (Ultra XGA) display mode LCD monitors operated with about 200 MHZ bandwidth input video signals.

What is claimed is:

1. A horizontal position control circuit for use in a high-resolution liquid crystal display (LCD) monitor to adjust the horizontal position of an image displayed on a screen of said LCD monitor, comprising:

an analog-to-digital converter for converting analog video signals into the corresponding digital video data;

a frame memory for storing the digital video data;

a key input controller for invoking a set of horizontal position control signals; and a controller in response to the horizontal position control signal to adjust a sampling point of the analog-to-digital converter so that the horizontal position is adjusted by a pixel unit, and to adjust a write operation of the frame memory so that the horizontal position is adjusted by multiple pixels.

2. The control circuit of claim 1, wherein the analog-to-digital converter divides the input analog video signals by 2N, where N is an integer, and wherein the sampling point is determined by the status of horizontal position control signals provided by the controller.

3. The control circuit of claim 2, wherein the frame memory includes a plurality of memories which store the divided by 2N digital video data output from the analog-to-digital converter.

4. The control circuit of claim 1, wherein the frame memory includes a plurality of memories which store the divided by 2N digital video data output from the analog-to-digital converter.

5. A horizontal position control circuit for use in a high-resolution liquid crystal display (LCD) monitor to adjust the horizontal position of an image displayed on a screen of said LCD monitor, comprising:

a key pad for adjusting the horizontal position of an image displayed;

a key input controller for invoking a horizontal position control signal in response to input key signal;

an analog-to-digital converter for dividing analog video signals by 2N, where N is an integer, and for converting the divided analog video signals into corresponding digital video data;

a frame memory for storing the digital video data output from the analog-to-digital converter; and a controller responsive to the horizontal position control signal to adjust a sampling point of the analog-to-digital converter so that the horizontal position is adjusted by a pixel unit, and to adjust output timing of write enabling signals directed to the frame memory so that the horizontal position is adjusted by multiple pixels.

* * * * *